US005413545A

United States Patent [19]

Bermann

[11] Patent Number: 5,413,545

[45] Date of Patent: May 9, 1995

[54] TRAINING DEVICE, ESPECIALLY FOR DOWNHILL SKIERS

[76] Inventor: Alexander Bermann, Max-Kahlke-Weg 1, Glückstadt, Germany, 25348

[21] Appl. No.: 174,157

[22] Filed: Dec. 27, 1993

[51] Int. Cl.[6] ..... A63B 69/18; A63B 22/16

[52] U.S. Cl. ..... 482/71; 472/91; 482/146

[58] Field of Search ..... 482/70, 71, 146, 147, 482/148, 51, 111; 472/91

[56] References Cited

U.S. PATENT DOCUMENTS 3,195,889 7/1965 Hall ..... 472/91
3,441,271 4/1969 Palacios ..... 482/71
4,200,282 4/1980 Agyagos ..... 482/147
4,220,329 9/1980 Agyagos ..... 482/147

FOREIGN PATENT DOCUMENTS 2410126 9/1975 Germany ..... 482/71

*Primary Examiner*—Stephen R. Crow
*Attorney, Agent, or Firm*—Klein & Vibber

[57] ABSTRACT

A training device is capable of simulating for a person being trained by the device the motion of a slalom or "wedeln" skiing. The device includes at least two rotating disks which are operatively connected to each other and rotate in opposite directions. The disks function as platforms for supporting a skier who is being trained by the device. The person being trained changes his or her position by jumping or stepping rhythmically from one platform to the other in simulation of wedeln and/or slalom and or wider downhill ski turns on parallel skis.

19 Claims, 5 Drawing Sheets

TRAINING DEVICE, ESPECIALLY FOR DOWNHILL SKIERS

BACKGROUND OF THE INVENTION

The invention relates to a training device, especially for downhill skiers learning and practicing wedeln and as well as short turns such a slalom turns as well as wider turns with parallel skis including also intermittent downhill skiing between turns.

In alpine skiing the skier changes direction by means of wide or short so called "parallel ski turns". The velocity of the skier depends on the angle of the slope in view of the fact that the skier does not ski straight downhill but traverses the slope diagonally and turns from one diagonal direction to an opposite diagonal direction by means of the so called "parallel ski turns" which differ from so called "stem turns". In wedel skiing the velocity of the skier can also be predetermined in relation to the slope, whereby the short turns follow each other more rapidly along a wave line. The wedeln motion and the turns are effected by the skier by shifting the center of gravity and the turning of the body of the skier. The learning and controlling of these rhythmic movements are some of the most difficult skills for a skier to acquire. It is particularly difficult to learn to maintain your equilibrium during the turning motion, which turning motions must be introduced by a small jump in order to maneuver the skier's parallel skis into a new direction. Such movements could heretofore only be carried out on a real ski slope. Since such wedeln requires a large number of rapid rhythmic movements this type of skiing is particularly difficult to learn for the average weekend skier who only has a few hours of skiing available to him on occasional weekends.

There are already known a number of training devices for learning how to ski. One of these known training devices includes a number of elastic planks which swing in a parallel plane by means of which ski turns can be learned. However, such a training device does not require the person using the training device to actually use centrifugal forces when training on the device so that the training effect on such a device is limited to hip movements without thereby sufficiently training the person using the device in maintaining his or her equilibrium.

In order to train a person to maintain his or her equilibrium under the influence of centrifugal forces, while learning how to effect parallel turn skiing, there has already been proposed to position a skier within the periphery of a rotating disk and, by shifting his or her center of gravity, to compensate for the centrifugal forces generated by the movements of his or her body. With such a known training device the skier can also assume various crouching positions to train for such skiing motions. In view of the fact that the use of this training device does not involve changing directions and the skier does continuously turn with the disc, the exercise and training effect of this known training device are also limited.

SUMMARY OF THE INVENTION

The object of the invention is to provide a training device which is particularly adapted for learning and for training parallel turn skiing which device simulates skiing conditions more realistically as the prior art devices have been able to simulate heretofore.

Based on this object, it is proposed to provide a training device which includes at least two operatively connected oppositely rotatable disks having slightly domed shapes in cross-section for supporting at least one skier who shifts position from one to the other disk to simulate the wedeln or parallel ski turning motions. The wedeln motions are effected tangentially from one disc to the other. The wedeln is introduced by the skier at the right moment carrying out a small jumping motion, whereby he leaves the disc on which he supports himself or herself in a tangential direction, and, if the wedeln movements are correctly carried out, lands on the other disc in a tangential direction as well. These motions of the human body correspond closely to the transitional body movements when wedel skiing along of one arc on the ski slope during wedeln to an other oppositely curved arc on the ski slope. The skier must, during his dwell time on one rotating disc, compensate for the centrifugal forces engendered by the shifting of his center of gravity, and then must assume an essentially erect position during the jump, and, at the moment of landing on the oppositely rotating adjacent disc, carry out a shift of his center of gravity in the opposite direction. In the event the training device includes only two adjacent discs, the skier carries out on one disc almost a complete revolution before he or she shifts again to the other adjacent disc.

In order to enable beginners to also use the training device an adjustable driving mechanism for regulating the rotational speed of the discs can be provided. The training device can therefore be adjusted in a stepless manner to rotate at a slower speed for beginners and at gradually higher speeds for more advanced or expert skiers. In a further embodiment of the invention the angle and conditions of the actual ski slope can be simulated by providing the training device with a mechanism for adjustably inclining the planes of the rotating discs relative to each other or to a ground plane of reference. In this way the slope, undulations of the ground and ground depressions can be simulated.

For the wedeln training exercise the circumferential peripheries of the pair of oppositely rotating discs are arranged so as to be in contact with each other or in close proximity to each other. The surfaces of the pair of oppositely rotating discs can be mounted at a short distance from each other and the space there between can be formed by a platform which is covered by a gliding or rolling surface material. In such an embodiment the skier does not jump directly from one disc to the other adjacent disc, but jumps first onto the platform having the gliding surface which is disposed between the pair of discs and glides or rolls over this surface in a tangential direction relative to the rotating disc and jumps at the right moment onto the adjacent oppositely rotating disc. In such an embodiment the body of the skier remains, during the gliding or rolling motion over the surface material of the platform, in an attitude in which the center of gravity is positioned over the feet of the skier and only shifts the center of gravity again when he or she has reached the second oppositely rotating disc. This exercise corresponds to the movements of a skier traversing short or wide parallel ski turns along a path which is diagonal to the ski slope.

The discs can be driven at different rotational speeds and can also have different diameters in order to train for short or wide parallel ski turns.

In order to also simulate the so called mogels on a ski slope there can be provided a mechanism for shifting periodically the vertical position of each disc.

In order to facilitate the transfer from one to an other closely mounted disc and to include the use of the usual ski poles there can be mounted between the pair of discs a pair of elastic ski poles. This pair of ski poles is mounted on the platform located between the pair of discs in such a way that the ski poles can be briefly gripped by the skier at the moment the skier jumps from one disc to the adjacent disc.

In order to prevent any injuries to a beginner learning how to ski on the device of this invention the skier who loses his balance may be connected to a tether which permits complete freedom of movement but prevents a crash landing of the skier by braking his fall with the tether.

It is also possible, of course, to provide, instead or in addition to a tether, a safety fence or a cushioned area around the training device. Instead of the cushioned area the entire device can be mounted in a swimming pool so that the skier when falling off the device simply falls into the swimming pool.

In order to simulate in particular the wedeln exercise, a larger number of discs, for example eight or ten discs can be mounted in a row, one behind the other, each disc of the row of discs rotates in an opposite direction relative to the adjacent disc and the row of discs is mounted on an inclined surface. Such an arrangement simulates in addition to the wedeln a forward ski movement over an extended track.

In order to intensify the downhill wedeln effect the angle of the ski slope can be adjusted (i.e. increased) by mounting the entire arrangement on an inclined support the angle of inclination of which can be adjusted by a suitable mechanism.

If spatial conditions permit it three, four or a larger plurality of rotatable discs can be mounted in triangular, square, etc. arrangements.

In order to simulate slalom skiing conditions a slalom flag pole can be elastically mounted on each the rotating disc at a predetermined distance from its axis of rotation.

The training device of this invention can not only be used as a training device for learning alpine skiing , but also as a fitness training device for rehabilitating persons suffering from equilibrium maintenance problems and also as a recreational device in amusement parks or can be installed and used at a fair.

BRIEF DESCRIPTION OF THE DRAWING

With these and other objects in view, which will become apparent in the following detailed description the present invention, which is shown by example only, will be clearly understood in connection with the accompanying drawing, in which:

FIG. 11*a* is schematic view in perspective of a sixth embodiment of the invention in which a slalom flag pole is elastically mounted on each rotating disc of a pair of oppositely rotating discs and a ski pole is mounted on the stationary support platform there between;

DESCRIPTION OF THE PREFERRED EMBODIMENTS

Figure 1:
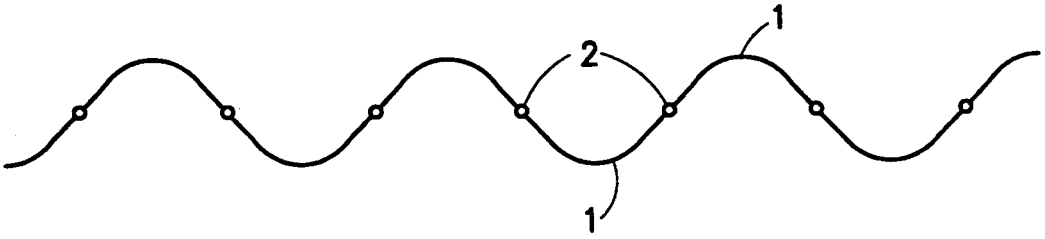
FIG. 1 illustrates schematically a wedeln ski track with wherein the turning points are indicated.

FIG. 1 illustrates a ski track which is traversed by a skier who is wedeln downhill on a ski slope. This ski track includes several short track sections 1 each one of which has a turning point 2. The skier shifts his center of gravity at the turning points 2 while simultaneously turning his body and the parallel skis, whereby a turning by the skier is carried out. To carry out such movements the skier must, while traversing the track section 1, compensate for the engendered centrifugal forces by shifting his center of gravity inwardly, then straighten his or her body at the turning points 2 and shift the center of gravity to the opposite side.

Figure 2:
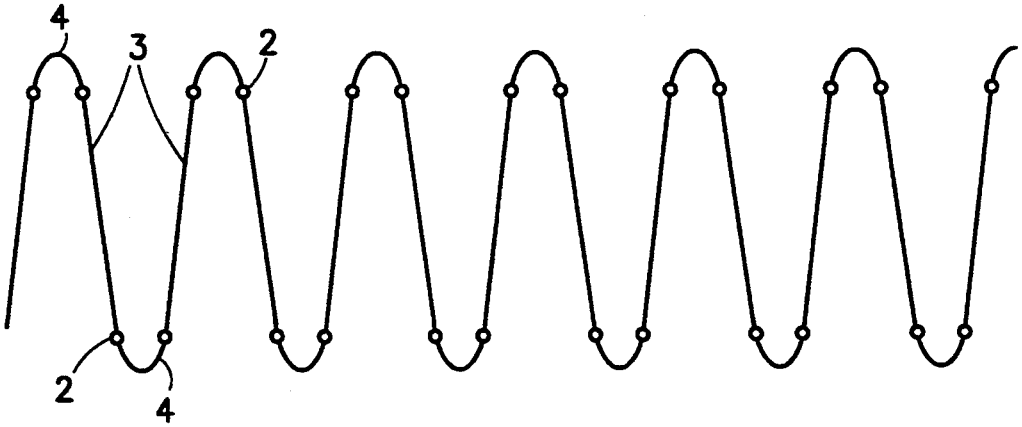
FIG. 2 illustrates schematically a longer more gradual ski track in which the turning points are also illustrated.
Figure 3:
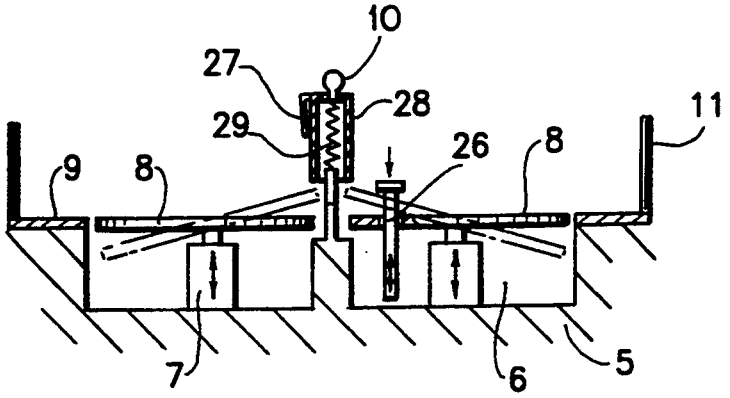
FIG. 3 is a cross-sectional view through the training device of this invention.

While in wedeln the short ski track sections directly follow each other without any intervening transitional ski track sections, there are illustrated in FIG. 2 more or less extended intervening ski track sections 3 which are connected to each by means of short or wide parallel turns 4 at the turning points 2. This type of skiing at each turn, when the skier must shift his or her the center of gravity inwardly, is followed by a transitional straight track during which the center of gravity of the skier must be located over his or her feet.

The sequence of movements of the skier for wedeln as illustrated in FIG. 1 can be closely simulated by the device of this invention as illustrated in FIGS. 3,4,6,8 and 9. The sequence of movements of the skier for parallel turn skiing as illustrated in FIG. 2 can be closely simulated by the device of this invention as illustrated in FIG. 5. In order to train for both sequence of movements as illustrated in FIGS. 1 and 2 a combination of the first and second embodiments of the invention, illustrated in FIGS. 4 and 5, mounted on one support, can be provided.

In its simplest construction the training device of the invention comprises a pair of discs 8 which are operatively connected to a platform 9 and the entire arrangement is mounted over a ground support surface 5. Each one of the discs 8 is supported by a driving member 7, which respectively rotates each disc 8 at adjustable speeds. The driving members 7 preferably include, in addition to the driving mechanism, a lifting and raising and lowering mechanism as well as a hydraulic swivel mechanism 26 to simulate mogels. The driving mechanisms 7 may therefore lift or lower the discs 8 relative to the ground surface 5 and platform 9 by means of, for example, a hydraulic cylinder-piston arrangement while at the same time also tilting the discs relative to each other to simulate the skiing conditions when skiing over mogels. The tilting can be effected by a separate hydraulic piston-cylinder arrangement 28 which slidably engages the underside of each rotating disc 8 to move each disc 8 to a preselected tilted position as shown in dashed lines in FIGS. 4 and 5. The position shown in dashed lines represents a simulation of the skiing condition while skiing over a mogel, while an opposite tilted position would simulate skiing over a subsequent depression on the ski slope. The platform 9 is covered with a soft material (not illustrated) to cushion the falls of the person using the training device and to simulate snow. An elastic ski pole mechanism 10 is mounted between the pair of discs 8 either on the ground surface 5 (FIG. 4) or on the platform 9 (FIG. 5). The various raising and lowering effects of the discs 8 is effected by moving the various hydraulic mechanisms in the directions shown by the double arrows in FIG. 4.

The elastic ski pole mechanism 10 may include a cylinder 28 housing a spring 29 and rod fixed on the ground support surface 5 or platform 9 which supports the cylinder 28, A wrist support loop 27, fixed near the hand grip of the ski pole mechanisms, can be optionally provided and serves to further simulate actual skiing conditions. The ski pole is grasped by the skier at the moment that a skier normally uses a ski pole to assist in turning by inserting the ski pole into the ground. At the moment the skier grasps the ski pole he carries out a small jump away from one rotating disc onto the another oppositely rotating adjacent disc. At the moment the skier is no longer in contact with the disc 8 he or she moves in a tangential direction along the arrow 12 (FIG. 4) and lands also in a tangential direction on the adjacent disc 8. If during this transitional movement the skier carries out the necessary shifting of his or her center of gravity in a correct manner he then follows the rotation of the disc 8 on which he has just landed for nearly a 360° angle and then transfers again in the aforedescribed manner onto the adjacent oppositely rotating disc. During these transitional movements the skier grasps alternately the ski pole with his right or left hand depending in which tangential direction the transfer is taking place.

The surface of the discs 8 is made of a composite material which prevents slippage even at high rotational speeds of the discs 8. The surface of the platform 9 or 13 is, however, made of a material which is slippery to simulate the surface of real snow. For example the surface can be made of known synthetic materials which are used for artificial ski slopes or it can be made of rollers or balls which are rotatable in all directions.

The entire arrangement presents a substantially closed imperforate surface to the skier to prevent any clamping, pinching, squeezing or any other kind of injury to the human body by a person training on the device. To further prevent any injury an elastic fence 11 can be mounted around the outer periphery of the training device to elastically prevent the skier from falling outside of the training device thereby further preventing an injury. In addition or in lieu of the elastic fence a tether arrangement can be provided to which the skier using the device is tied during use.

Figure 4:
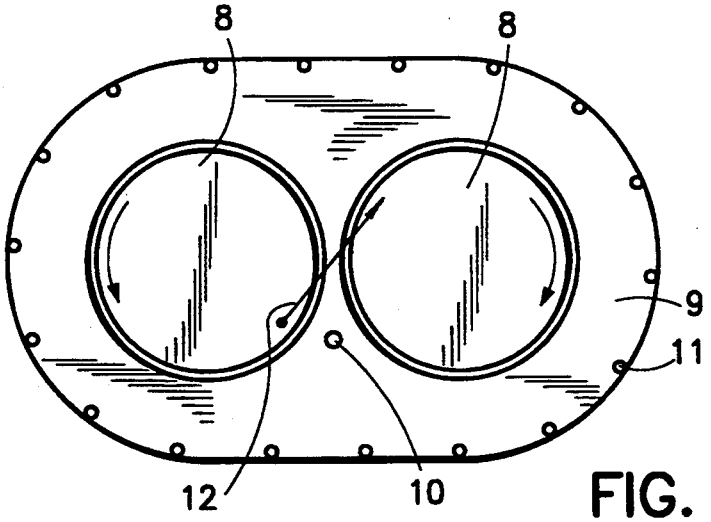
FIG. 4 is a plan view of the training device as illustrated in FIG. 3.
Figure 5:
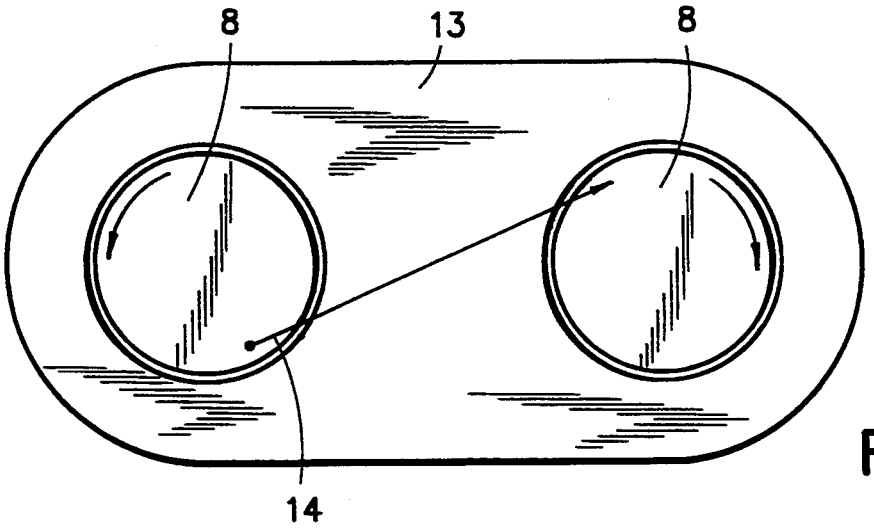
FIG. 5 is a plan view of a second embodiment of the training device of this invention in which the pair of oppositely rotating discs are mounted at a greater distance from each other.

An underground compartment 6 of preselected size is provided in the ground surface 5 to accommodate therein the pair of driving mechanisms 7 and the tilting mechanism 28 as shown in FIG. 4.

While in the embodiment of FIG. 4 the transfer by a person using the training device is carried out directly from one rotating disc to the adjacent oppositely rotating disc, the transfer in the embodiment of FIG. 5 is carried out indirectly. In this embodiment the pair of discs 8 are mounted at a greater distance from each other and a portion of the surface of the platform 13 is disposed there between. The surface of the platform is made of a material, such as a synthetic ski surface material or material covered with balls or rollers that have superior gliding properties so that the skier, when leaving one rotating disc 8 glides in a tangential direction along the arrow 14 over the surface of the platform 13 and lands on the oppositely rotating disc 8 by means of a small jump. The skier then dwells on the disc 8 while rotating through an angle of about g270° and then leaves the disc 8 in a tangential direction and now glides over the platform 13 in the direction towards the other disc 8. The skier preferably only wears sport shoes or ski boots when training on the device of FIG. 4. However, when training on the device of FIG. 5 the skier preferably should wear ski boots and optionally short skis.

Figure 6:
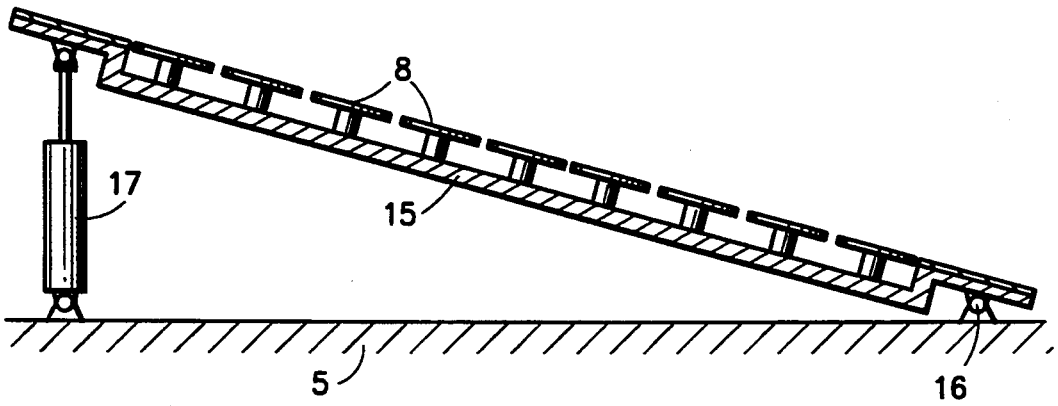
FIG. 6 is a side elevational view of a third embodiment of a training device in accordance with this invention in which a plurality of discs are mounted in a row on an support the angle of inclination of which is adjustable.

The embodiment of FIG. 6 comprises a larger than two plurality of discs 8 which are mounted on a support member 15. All of the discs 8 are rotatable in opposite direction to the adjacent discs 8 by suitable driving mechanisms of the type described in conjunction with the embodiment of FIG. 3. These driving mechanisms are operatively mounted on the support member 15 as shown in FIG. 6. The top surface of the top and bottom portion of the support member 15 is also provided with a synthetic ski surface material. An elastic ski pole (not illustrated), as described in conjunction with FIG. 3, can be provided between each pair of adjacent discs 8. The support member 15 is pivotally supported at its bottom end by means on the ground surface 5 by means of a conventional hinge 16. The top portion is pivotally connected to a hydraulic piston-cylinder arrangement 17 which is in turn pivotally supported by an other conventional hinge 16. By raising or lowering the support member 15 by means of the piston-cylinder arrangement 17 the steepness of the slope angle of the entire device can be adjusted to simulate actual skiing conditions.

Figure 7:
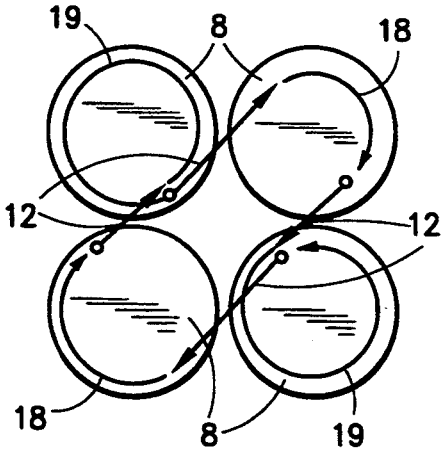
FIG. 7 is a plan view of fourth embodiment of training device in accordance with the invention in which four rotatable discs are mounted along a square on a support.

There is schematically illustrated in FIG. 7 a fourth embodiment of the invention in which four discs 8 are mounted closely to each other rotatably on a support (not illustrated) in square-shaped pattern. The discs 8 are oppositely rotated by previously described driving means and the person using the device leaves each disc in a tangential direction as indicated by the arrows 1.2. The arrows 18 and 19 indicate the dwell times on the discs 8 of the person using the device. Thus the arrow 18 indicates the dwell time on one pair of discs 8 only amounting to about a half revolution of the discs 8, whereas on the other pair of discs 8 the person using the device remains on the respective disc 8 for almost a complete revolution of the discs 8.

The fourth embodiment as illustrated in FIG. 7 provides the person using the device a more variable form of exercise as the embodiments of FIGS. 4 and 5 without requiring as much space as does the embodiment of FIGS. 5 and 6.

The disc diameter can vary from 0.75 meters to 3.0 meters, depending on whether wedeln or wider turns are to be the training object of the device. The device may include discs of different diameters and the individual discs may be driven at different speeds.

Figure 8:
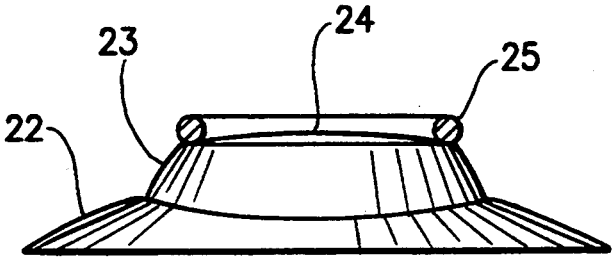
FIG. 8 is a cross-sectional view of a rotatable disc of the training device of the invention.

There is illustrated in FIG. 8 a cross-sectional view of a rotatable disc 8 of the training device of the invention. This disc 8 has a step like protruding annular portion 23 the top of which forms a circumferential surface 24. A ring member 25 can be mounted on top of the central portion 24 and serves as a hand rail for a person using the device. Adjoining the annular portion 23 is an outer annular portion 22. The angle of inclination of the inner portion 23 is steeper than that of outer annular portion 22. The arrangement of various surfaces as illustrated in FIG. 8 further simulate actual skiing conditions because it causes the feet of the person using the device to assume the positions which most frequently occur during skiing over uneven ski slope surfaces having varying degrees of steepness.

Figure 9:
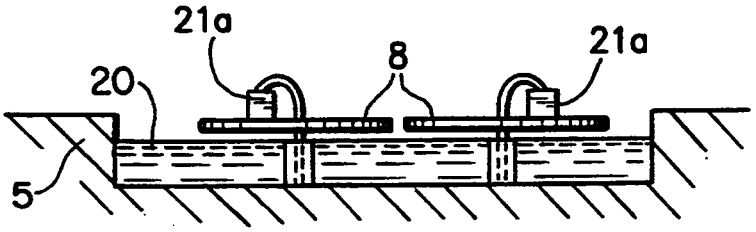
FIG. 9 is a cross-sectional schematic view of a fifth embodiment of the invention wherein the training device is mounted in a swimming pool.
Figure 10:
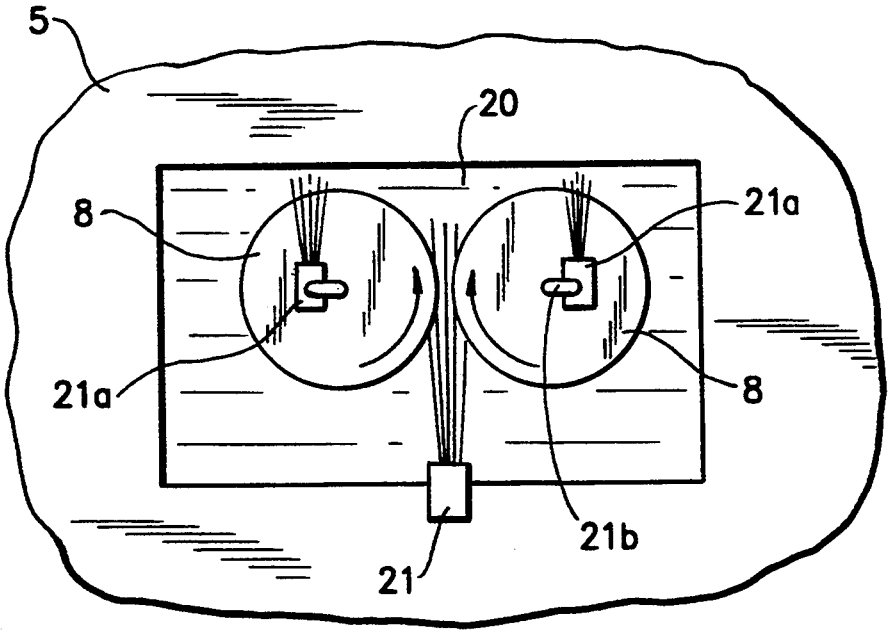
FIG. 10 is a plan view of the training device illustrated in FIG. 9.

FIGS. 9 and 10 illustrate schematically in cross-section (FIG. 9) and plan view (FIG. 10) a fifth embodiment of the invention which is mounted in a swimming pool. The obvious advantage of this embodiment is that it cushions the fall of the skier should he or she fall of one of the rotating discs 8. In this embodiment the discs 8 are mounted so that their top surfaces rotate slightly above the surface of the water in the swimming pool 20. There is mounted on the ground surface 5 a spout 21 emitting a water jet which is directed to the area between the pair of rotating discs 8, so as to rotate them jointly in opposite directions as shown by the arrows in FIG. 10. Alternately or additionally the driving of the discs 8 can be effected by having a pair of waterspouts 21*a* mounted eccentrically relative to the axial support shafts of the discs 8 and being rigidly connected thereto by conduits 21*b* which emit water jets through spouts 21*a* to rotate the discs 8. The discs 8 can also or alternatively be driven by conventional motor driven underwater driving means.

Figure 11A:
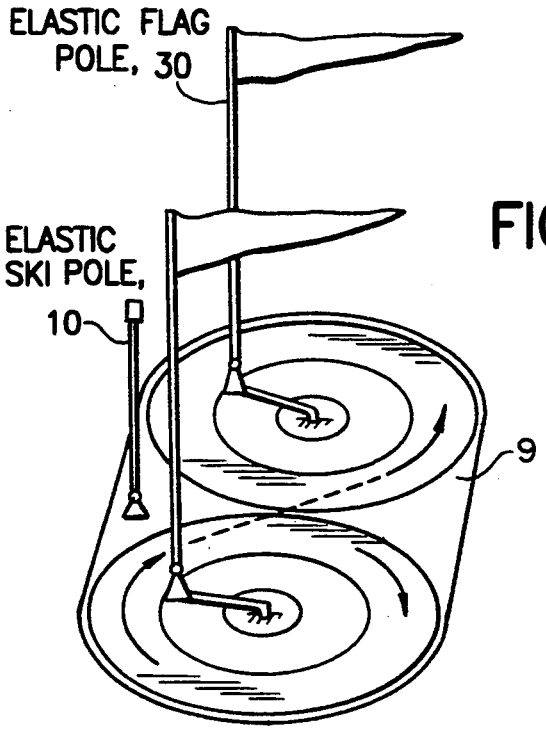
Figure 11B:
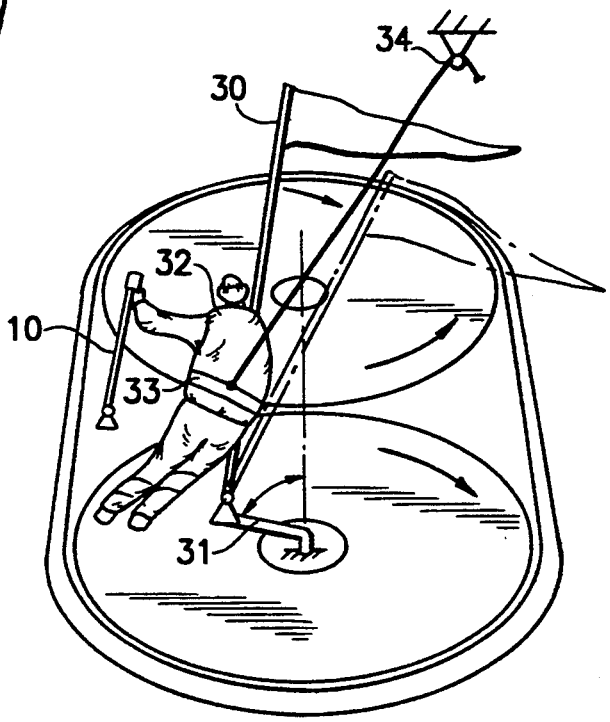
FIG. 11*b* is a schematic view in perspective of the device shown in FIG. 11*a* in which a skier, connected to a tether, is shown using the training device.
Figure 11C:
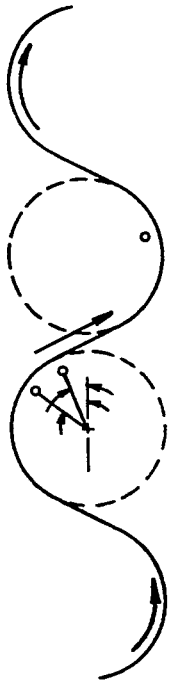
FIG. 11*c* is a schematic plan view showing the relationship of the position of the flagpole on the rotating disc when being contacted by the skier and the angle of rotation which is being traversed by the rotating disc thereafter before the skier jumps on the adjacent oppositely rotating disc.

FIGS. 11*a* to 11*c* illustrate schematically in perspective the device of FIG. 4. In addition to the ski pole 10 an elastically mounted flag pole 30 is mounted on each rotating disc 8 at a predetermined distance from the axis of rotation. The distance of the flagpole 30 from the axis of rotation can be adjusted by mounting it on an adjustable arm 31 which fixed to the axial driving mechanism 7. The skier 32 can be optionally connected by means of a belt 33 to a tether mechanism 34. The position of the flag pole 30 relative to the point at which the skier is suppose to jump to the adjacent disc is shown by the angle between the arrows in FIG. 11*c*.

The training device of this invention makes it possible to train year-round for most of the movements which a skier performs during alpine skiing. By making the diameters of the discs 8 sufficiently large and/or providing a larger than two plurality of discs mounted in a row or in a multi-corner pattern several skiers may train on the device simultaneously.

The training device of the invention can not only be used in an exercise hall for ski training but in a swimming pool of a ski resort or in a rehabilitation center for training persons having equilibrium maintenance problems and also as a recreational device in amusement parks or fairs.

While the invention has been described in detail by specific reference to preferred embodiments thereof, it is understood that variations and modifications may be made without departing from the true spirit and scope of the invention.

What is claimed is:

1. A training device for skiers, comprising in combination, at least a pair of circular discs which are rotatably mounted on a support to form support platforms for a skier, driving means operatively axially connected to each said pair of circular discs for rotating them in mutually opposite directions, whereby the skier shifts from one rotating disc to the other by jumping or stepping onto the adjoining oppositely rotating disc to simulate wedeln or parallel downhill ski turns.

2. The training device as claimed in claim 1, wherein each one of said driving means is adjustable to adjust the rotational speed of each disc of at least said pair of discs which is driven thereby.

3. The training device as set forth in claim 2, wherein each disc is axially and swivellably supported by said driving means and including a tilting mechanism for each disc which engages the underside of each rotating disc for moving it into preselected tilted positions relative to its driving means.

4. The training device as set forth in claim 3, wherein said discs are mounted in peripheral contact or near contact with each other so that their peripheries are in close proximity to each other.

5. The training device as set forth in claim 2, wherein at least two coacting discs are mounted on said support so that their peripheries are spaced from each other, a platform disposed between the peripheries of said two discs in the same plane in which said discs rotate, said platform being covered with means which facilitate gliding over said means by the skier using the training device and also cushioning on impact the skier when falling off one of said discs onto said platform.

6. The training device as set forth in claim 2, wherein the discs have different diameters.

7. The training device as set forth in claim 1, wherein each one of said driving means include a hydraulic cylinder-piston unit for adjustably raising or lowering the disc which is drivingly connected thereto.

8. The training device as set forth in claim 3, wherein a ski pole is elastically mounted on said support between said pair of discs.

9. The training device as set forth in claim 1, including a safety fence mounted on said support for protecting the skier using the training device including by preventing a fall outside of a protected designated area.

10. The training device as set forth in claim 1, wherein a plurality greater than two discs are mounted in a row on said support.

11. The training device as set forth in claim 10, wherein said support is pivotally mounted at one of its ends and is supported by a hydraulic piston-cylinder mechanisms at its other end which is pivotally connected to said support at one of its ends and is pivotally supported on the ground at its other end.

12. The training device as set forth in claim 1, wherein each disc has at least one frusto-conical shape in cross-section.

13. The training device as set forth in claim 12, wherein said frusto-conical shape includes at least two steps in cross-section for simulating actual ski slope mogel conditions.

14. The device as set forth in claim 1, wherein said support is mounted in a swimming pool.

15. The device as set forth in claim 14, wherein said driving means include first water jet means which direct a jet of water in the region between two adjacent discs thereby rotating said discs in opposite directions.

16. The training device as set forth in claim 14, wherein said driving means for each disc include second water jet means which are eccentrically mounted relative to said axial driving means and each second water jet means is rigidly connected to the axial driving means and emits a water jet to rotate the corresponding disc.

17. The device as set forth in claim 1, including a tether mechanism connected to the skier while using the device.

18. The device as set forth in claim 3, including a flag pole elastically mounted on each rotating for simulating slalom skiing.

19. The device as set forth in claim 18, wherein said flag pole is mounted on an arm which is rigidly connected to said axial driving means, the radial length of said arm and the radial distance of said flag pole relative to said axial driving means being adjustable.

* * * * *